US005450644A

United States Patent [19]

Berman

[11] Patent Number: 5,450,644

[45] Date of Patent: Sep. 19, 1995

[54] SELF-CONTAINED SUBMERSIBLE DEBRIS CLEANER

[76] Inventor: Ken Berman, P.O. Box 1555, Boone, N.C. 28607

[21] Appl. No.: 209,902

[22] Filed: Mar. 14, 1994

[51] Int. Cl.[6] ..... E04H 4/16

[52] U.S. Cl. ..... 15/1.7

[58] Field of Search ..... 15/1.7, 398, 383, 347, 15/349, 350; 210/169; 55/379

[56] References Cited

U.S. PATENT DOCUMENTS

| | | | |
|---|---|---|---|
| 2,141,811 | 12/1938 | Everson | 15/1.7 |
| 2,725,356 | 11/1955 | Lombardi | 15/1.7 |
| 2,923,954 | 2/1960 | Babcock | 15/1.7 |
| 3,046,583 | 7/1962 | Drennan | 15/1.7 |
| 3,075,227 | 1/1963 | Bowles | 15/1.7 |
| 3,755,843 | 9/1973 | Goertzen, III et al. | 15/1.7 |
| 4,304,022 | 12/1981 | Sommer | 15/1.7 |
| 4,402,101 | 9/1983 | van Zyl | 15/1.7 |
| 4,498,206 | 2/1985 | Braukmann | 15/1.7 |
| 4,651,376 | 3/1987 | Ford | 15/1.7 |
| 5,317,776 | 6/1994 | DeMoura | 15/1.7 |

FOREIGN PATENT DOCUMENTS

| | | | |
|---|---|---|---|
| 476258 | 4/1975 | Australia | 15/1.7 |
| 758796 | 11/1933 | France | 15/1.7 |
| 2841411 | 9/1979 | Germany | 15/1.7 |

*Primary Examiner*—Edward L. Roberts, Jr.
*Attorney, Agent, or Firm*—Terry M. Gernstein

[57] ABSTRACT

A self-contained debris cleaner for use in cleaning debris from submerged surfaces, such as the bottom of a swimming pool, includes a bottom section having a brush mounted thereon to engage the surface being cleaned, a neck section, and a pump housed in a pump housing section. The pump draws fluid into the bottom section, through the neck section, and forces this fluid into a debris collection bag via a conduit. The bag is foraminous and is removably mounted on a cage that is removably mounted on the conduit. The cage includes a multiplicity of holes, and fluid, with debris contained therein, flows into the cage, with fluid flowing out of the bag, and debris remaining in the cage.

12 Claims, 3 Drawing Sheets

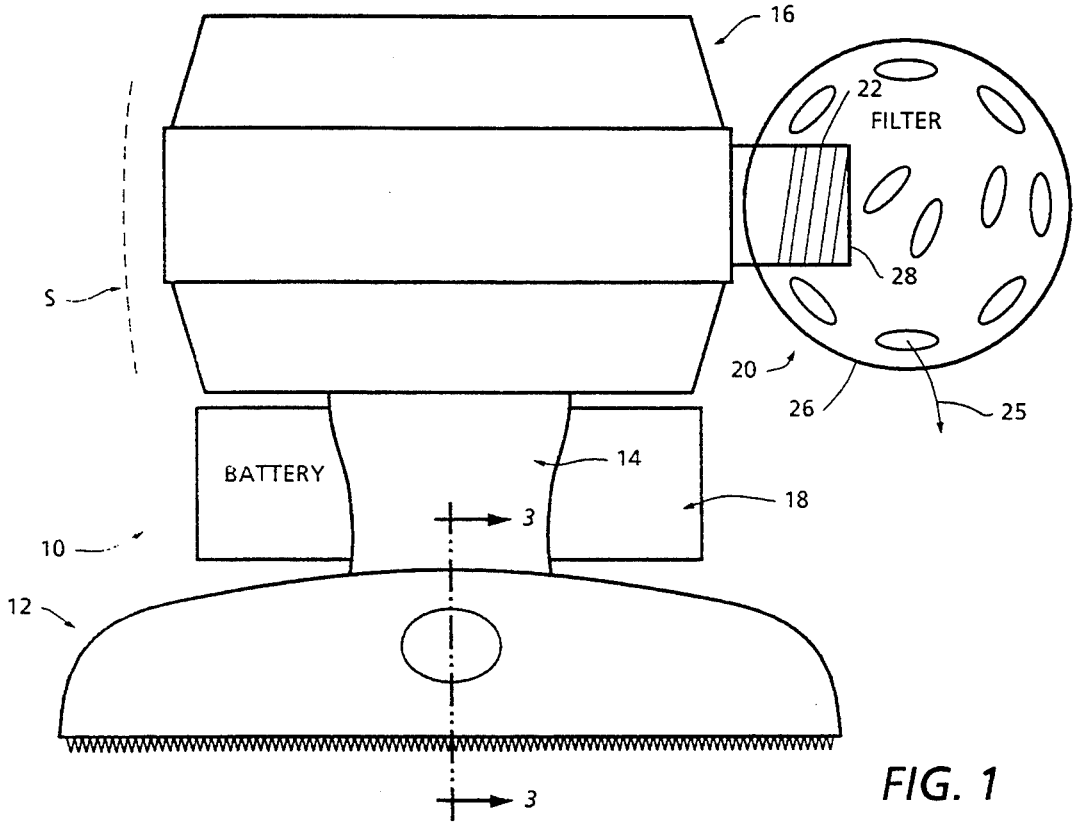
FIG. 1
FIG. 1
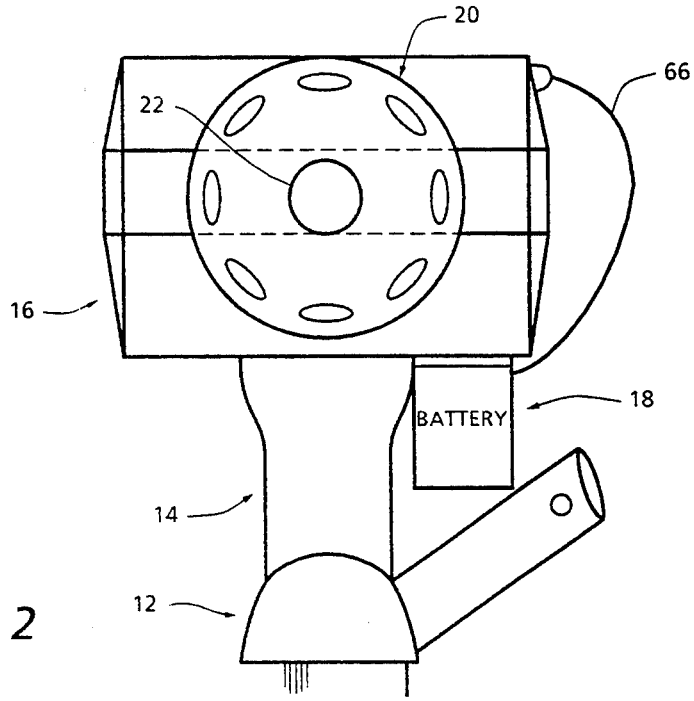
FIG. 2

SELF-CONTAINED SUBMERSIBLE DEBRIS CLEANER

TECHNICAL FIELD OF THE INVENTION

The present invention relates to the general art of cleaning implements, and to the particular field of swimming pool cleaning devices, specifically, such devices that remove debris from a swimming pool.

BACKGROUND OF THE INVENTION

As all swimming pool owners know, debris of various sizes can be a nuisance. Debris such as dirt, silt, leaves, and the like can be unsightly as well as unhealthy if not removed from the swimming pool.

Heretofore, most debris is removed using a pool vacuum system which includes a large motor, located either on the pool deck or in a central area, attached to a suction head by a long handle. The handle is manipulated to move the suction head about the pool. Otherwise, debris is generally removed by the pool filter system. While these devices and systems work well, they can be cumbersome and/or slow. Skimmers can also be used, but they may not be fast enough.

The drawbacks of these devices and systems are especially apparent if a quick "touch-up" type cleaning is all that is desired. That is, small debris is to be quickly removed in order to touch up the appearance of the pool for a party or the like. Such a touch up cleaning is in lieu of a full vacuuming of the pool. The cumbersome and slow nature of the known devices are especially problematic in such a touch up situation.

Therefore, there is a need for a device that is easy and quick to use for light cleaning of a swimming pool to remove small debris.

However, the device must be stable enough so it can be easily and surely manipulated. Therefore, there is a need for a device that is easy to use but is also stable when used.

OBJECTS OF THE INVENTION

It is a main object of the present invention to provide a device that is easy and quick to use for light cleaning of a swimming pool to remove small debris.

It is another object of the present invention to a device for cleaning small debris from a swimming pool that is stable in use.

It is another object of the present invention to a device for cleaning small debris from a swimming pool that is self-contained whereby it need not be connected to any other system to perform the cleaning function.

SUMMARY OF THE INVENTION

These, and other, objects are achieved by a self-contained debris removing unit that is light, yet has the heavy elements thereof located to ensure stability in use.

Specifically, the debris removing unit includes a bottom section that is manipulated along a surface of the pool, such as the bottom wall, beneath the water, by a handle that extends to and above the surface of the water. A submersible pump is connected to the bottom section to draw water, and debris contained therein, into the bottom section. A debris collection means is connected to the submersible pump to receive water and debris from the pump. The debris collection means includes a support cage with a foraminous bag covering the cage. Water flows though the bag, but debris is caught in the bag.

A rechargeable battery is mounted on the unit in a location to provide stability to the unit as that unit is manipulated about the pool beneath the water. The battery is heavy and dense enough to provide this stability, but is located near the center of gravity of the unit so the unit is stable. A brush is mounted on the bottom section to scrape the pool surface and loosen debris so it can be sucked into the unit by the pump.

BRIEF DESCRIPTION OF THE DRAWING FIGURES

FIG. 1 is front elevational view of a preferred form of the unit embodying the present invention.

FIG. 2 is a side elevational view of the unit shown in FIG. 1.

DETAILED DESCRIPTION OF THE PREFERRED EMBODIMENT OF THE INVENTION

Figure 3:
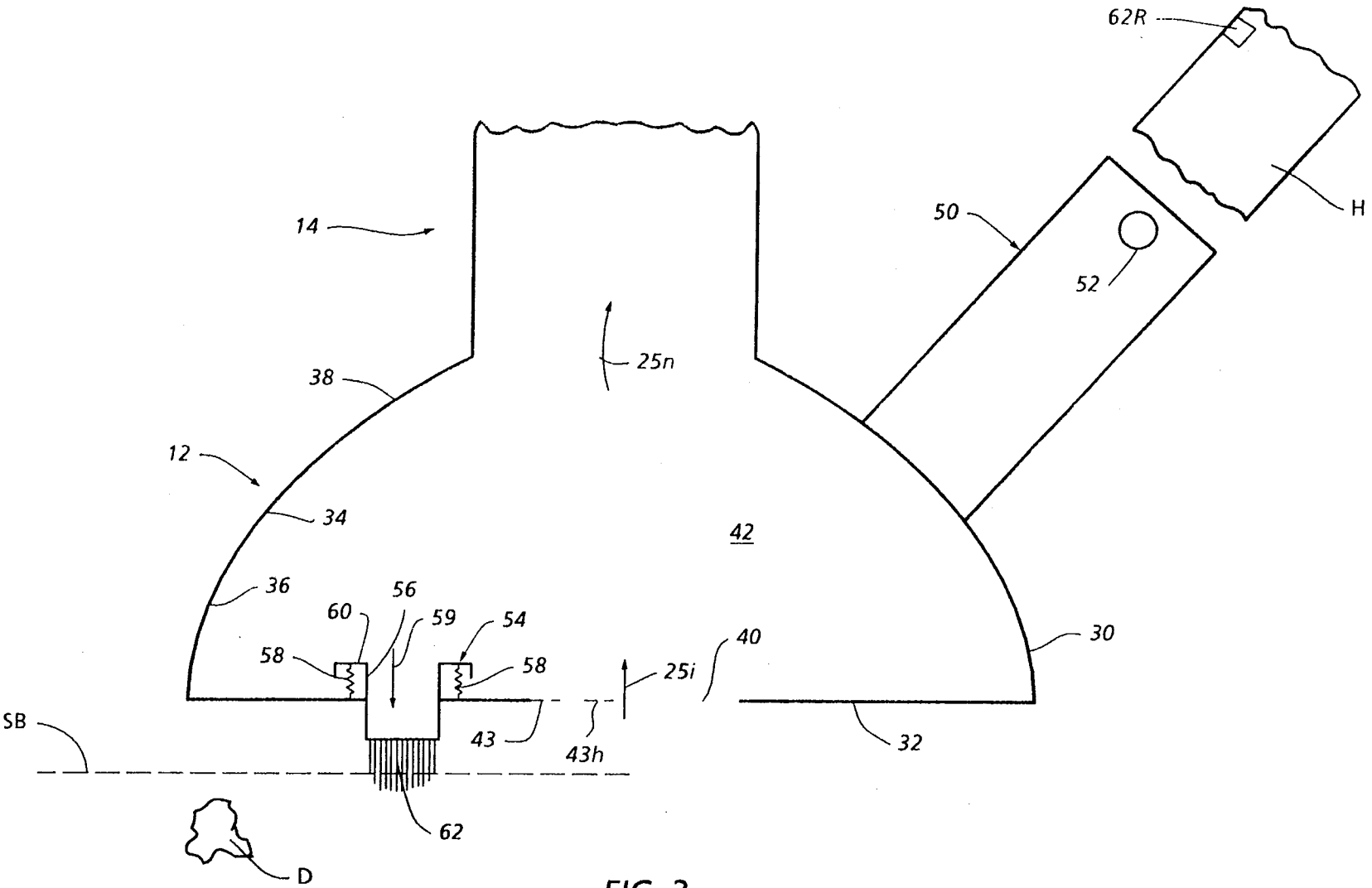
FIG. 3 is a cutaway side elevational view of the bottom housing of the unit as seen on line 3—3 of FIG. 1.

Shown in the Figures is a self-contained debris cleaner 10 that can be submerged and can be used to remove debris from a swimming pool. Cleaner 10 includes a bottom section 12 which is moved along a surface of a swimming pool, such as the bottom of that pool, during a cleaning procedure. Bottom section 12 is connected to a neck section 14, and debris is transferred via neck section 14 to a pump housing 16 under the influence of a pump located in housing 16 and powered by power unit 18 mounted on housing 16. Fluid, and debris contained in that fluid, is then transferred by the pump to a debris collection unit 20 via a conduit 22. A foraminous bag 24 surrounds a spherical cage 26 that is mounted on conduit 22 or otherwise mounted on housing 16. Foraminous bag 24 has a hole size that permits water, or fluid, to pass through the bag, but will retain debris within the bag. This feature is indicated by arrow 25. Cage 26 is removably mounted to the pump housing, and such removable feature is indicated in FIG. 1 by a threaded connection 28 on conduit 22 attaching to a co-operating threaded connection on the cage. Bag 24 is stretched over cage 26 for replacing that bag, or for cleaning the cage. A shroud S can be placed over the entire device for aesthetic purposes.

More specifically, referring to FIG. 3, bottom section 12, which can be formed of metal, plastic or any other suitable material, is shown to include a curved top 30 mounted on a planar bottom element 32 and having a debris-removal door 34 hingeably attached thereto by a hinge 36 and locked thereto by a lock 38. Door 34 is used to clean debris from bottom section 12 if necessary. An opening 40 is defined in bottom element 32 and water and debris contained therein passes through opening 40 in direction **25*i* under the influence of the pump in housing 16. This debris-containing fluid passes into neck section 14 in direction 25*n* after flowing through chamber 42 in section 12. A large-holed screen can be mounted on element 32 to cover opening 40 if desired to prevent large debris from being sucked into the unit and, perhaps, clogging the unit. Such a screen is indicated in FIG. 3 by reference number 43, with hole 43*h* being large enough to pass all debris of interest to cleaner 10, but small enough to so that debris large enough to be blocked by screen 43 would clog cleaner 10**.

A sleeve 50 is mounted on curved top 30 and releaseably couples a handle H to debris cleaner 10. Handle H is of the type commonly used in swimming pool cleaning, such as a telescoping handle, and thus is shown schematically with no further discussion as those skilled in the art will understand what type of handle will be necessary. Handle H is attached to sleeve 50 by a set screw 52 or lock pin, and is used to move debris cleaner 10 about the swimming pool from the deck of that pool.

Debris D, such as silt, leaves, dirt or the like, on surface SB, such as the bottom surface of a swimming pool, can be loosened or moved by brush unit 54 mounted on bottom element 32. Brush unit 54 includes a housing 56 attached to bottom element 32 by tension springs 58 that bias housing 56 downwardly in direction 59 and have one end mounted on bottom element 32 and another end engaged in a spring seat 60 of housing 56 to be captured by the housing 56. Bristles 62 are mounted on housing 56 to be forced against surface SB as bottom section 12 is moved along that surface. The downward bias of springs 58 is overcome by the user and by the weight of the unit 10 but assists in forcing bristles 62 against surface SB with force sufficient to loosen debris D whereby the suction associated with cleaner 10 will draw such loosened debris into the unit in direction 25*i*.

Neck section 14 and pump housing 16 are also formed of metal, plastic or any other suitable material, and are hollow whereby fluid and debris from bottom section 12 flow through neck section 14 and into pump housing 16 as above discussed. Neck section is sized so that power means 18, such as a rechargeable battery, supported on pump housing 16 will be located above bottom section 12 but below pump housing 16. This locates the power means, which can be quite heavy as compared to the other elements of debris cleaner 10, near the center of gravity of the cleaner. Such placement of the heaviest element of the unit stabilizes the unit in use. As shown, the unit is sized so the power means has a length that essentially matches the overall length of the debris cleaner. This sizing distributes the weight of the power means along the length of the bottom section so gravity assists in the scraping function as well as provides stability to the cleaner 10. As shown, power means 18 is located superadjacent to sleeve 50 so the weight of power means 18 is borne on sleeve 50 without a long lever arm whereby cleaner 10 can be easily manipulated and will remain stable in use, even though power means 18 may be quite heavy as compared to the other elements of the unit.

Figure 4:
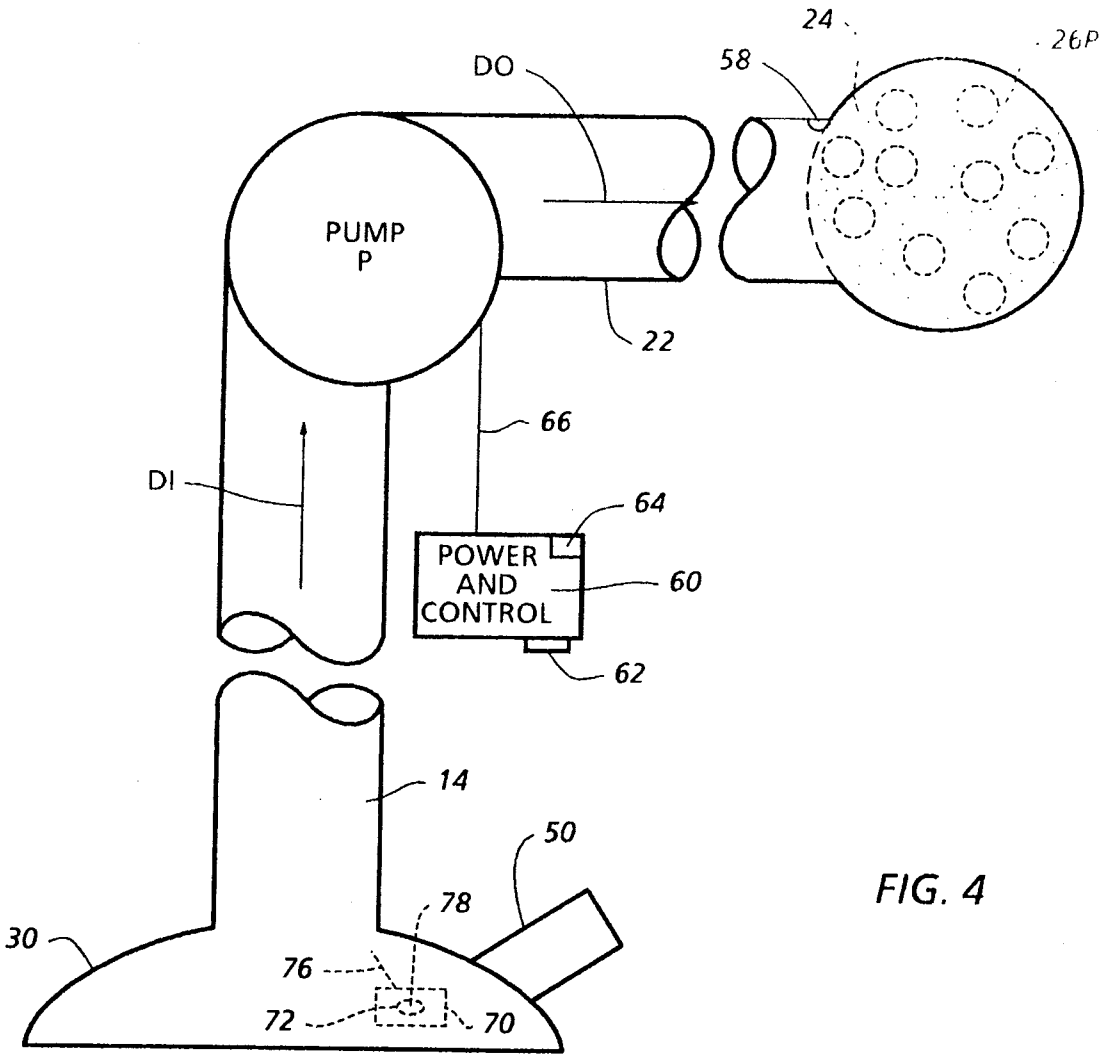
FIG. 4 is a schematic showing the fluid flow circuit in the unit.
Figure 5:
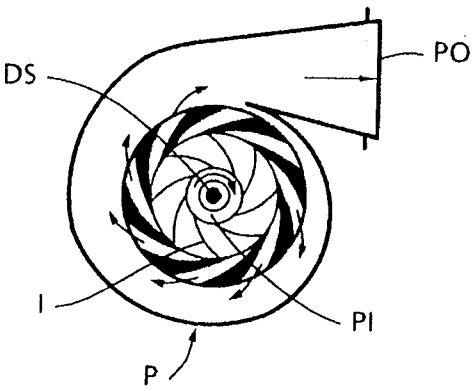
FIG. 5 shows a pump that could be used in the unit.

A submersible pump is located in pump housing 16, and a suitable pump is a bilge pump commonly found on boats; however, in the interest of a complete disclosure, another suitable pump P is shown in FIG. 5, with a fluid inlet PI fluidically attached to neck 14 to receive fluid and debris therefrom, and a fluid outlet PO fluidically attached to conduit 22 to force debris and fluid thereinto under the influence of impeller I mounted on drive shaft DS that is driven by power means 18. As shown in FIG. 4, fluid and debris pass into and through pump P in directions DI and DO.

As is also shown in FIG. 4, debris collection means 20 includes spherical cage 26 having a multiplicity of fluid passages, such as passage 26P, defined therein. Cage 26 can be formed of metal, plastic or other suitable material, and has bag 24 formed of net or other such material to include a multiplicity of small holes through which fluid can pass, but which will capture debris. Bag 24 is formed of stretchable material, such as nylon, so it can be stretched over cage 26 and will remain in place on that cage even as fluid passes through the bag. Debris will be captured inside cage 26, with holes 26P being larger than the holes in bag 24. If suitable, a strap, such as strap 58 can be used to releasably anchor bag 24 to conduit 22.

As is also shown in FIG. 4, cleaner 10 includes a control unit 60 that operates in conjunction with the power means. This control unit includes an on/off switch 62 that can be located either on the pump housing or can be remotely operated from a corresponding switch 62R (see FIG. 3) located on handle H. Power means 18 can include a battery similar to those used on an automobile, or can include other forms of battery as will occur to those skilled in the art based on the teaching of the present disclosure. Power means 18 can also include a recharging unit 64 that, for example, can plug into a cigarette lighter on a vehicle to recharge the battery. Power is transferred to the pump via line 66.

As can be understood from the foregoing, the debris cleaner 10 is self contained in that it generates its own power and uses that power to draw debris and fluid into and through the unit and then collects that debris onboard the unit. The self contained feature of the debris cleaner permits it to be used quickly and easily for minor "touch up" cleaning without requiring operation of large filter systems or large, and cumbersome equipment. The self-contained feature also permits the unit to be easily manipulated for such cleaning. In the preferred form of cleaner 10, pump P moves eight hundred gallons of liquid per hour, and power means 18 can operate the pump for thirty to forty minutes between charges.

If desired, brush unit 54 can include a motor-driven shaft connected to power means 18, with the bristles 62 mounted on the shaft to sweep surface SB. A motor with suitable gearing would then be placed in bottom section 30, with the axle extending across the bottom section from left to right in FIG. 1, with the motor being located directly beneath the battery for further stabilizing the overall unit. To indicate this form of the invention, a motor 70 is indicated in FIG. 4, with gearing 72 connecting that motor to a drive axle 74, which will mount bristles thereon in the manner of a house vacuum cleaner brush. Motor 70 is powered by power means 18 and the control means associated with the power means via a power cord 76, and is, like the gearing, submersible.

It is understood that while certain forms of the present invention have been illustrated and described herein, it is not to be limited to the specific forms or arrangements of parts described and shown.

I claim:

1. A self-contained debris cleaner for removing debris from a swimming pool comprising:

A) a bottom section which includes (1) a top surface and a bottom surface with said bottom surface being located adjacent to a surface of a swimming pool to be cleaned in use, (2) a brush means located adjacent to said bottom surface for scraping the surface of a swimming pool to loosen debris from that surface, (3) a sleeve on said bottom section for receiving a handle, and (4) a debris inlet defined in said bottom surface through which debris passes into said bottom housing;

B) a neck section having a bottom fluidically attached to the top surface of said bottom section and extending upwardly therefrom, and a top spaced from said bottom, with debris entering said neck section from said bottom section via said bottom;

C) a pump housing having a base mounted on the top of said neck section and being fluidically connected to said neck section, with debris entering said pump housing from said neck section, said pump housing being spaced from said bottom section and being located above said bottom section when in use;

D) a pump in said pump housing and fluidically connected to said debris inlet via said neck section for drawing debris into said bottom section inlet;

E) power means mounted on said pump housing adjacent to and outside of said neck section between said bottom section and said pump housing for operating said pump;

F) a debris collection means on said pump housing and fluidically connected to said pump to receive debris from said pump; and G) an on/off switch connected to said power means.

2. The debris cleaner defined in claim 1 wherein said debris collection means includes a foraminous collection bag.

3. The debris cleaner defined in claim 2 wherein said debris collection means further includes a support cage attached to said pump housing, with said collection bag covering said support cage.

4. The debris cleaner defined in claim 3 wherein said support cage is spherical and has a multiplicity of flow holes defined therein.

5. The debris cleaner defined in claim 4 further including a conduit fluidically connecting the interior of said support cage to said pump.

6. The debris cleaner defined in claim 1 wherein said power means includes a rechargeable battery supported on the outside of said pump housing beneath said pump housing and above said bottom section.

7. The debris cleaner defined in claim 1 wherein said brush includes a housing, spring means for attaching said brush housing to said bottom section and biasing said brush outward of said bottom section.

8. The debris cleaner defined in claim 1 wherein said bottom section has an outer periphery, said pump having an outer periphery smaller than the outer periphery of said bottom section and said neck section has an outer periphery that is smaller than the outer periphery of said pump housing.

9. The debris cleaner defined in claim 1 wherein said power means has two ends and a width dimension defined between said two ends, said pump housing having two sides and a bottom width dimension defined between said two sides adjacent to said base, and said power means width dimension being essentially equal to said pump housing width dimension.

10. The debris cleaner defined in claim 9 wherein said power means has a bottom edge and a top edge and a length dimension defined between said top edge and said bottom edge, said neck having a length dimension defined between said top surface and said top, said power means length dimension being at least one half the length of said neck section.

11. The debris cleaner defined in claim 10 wherein said sleeve is oval in shape.

12. The debris cleaner defined in claim 11 wherein said neck section has an outer dimension defined transverse to said neck section length dimension and said sleeve has a major axis that is over one half the neck outer dimension.

* * * * *